United States Patent [19]

Bernardis et al.

[11] 4,010,836

[45] Mar. 8, 1977

[54] WIRE PRINTING DEVICE

[75] Inventors: Francesco Bernardis, Ivrea; Dario Bisone, Montalto Dora, both of Italy

[73] Assignee: Ing. C. Olivetti & C., S.p.A., Ivrea (Turin), Italy

[22] Filed: Mar. 14, 1975

[21] Appl. No.: 558,292

[30] Foreign Application Priority Data

Apr. 10, 1974 Italy ..... 68140/74

[52] U.S. Cl. ..... 197/1 R; 101/335; 197/150; 335/274

[51] Int. Cl.[2] ..... B41J 3/04

[58] Field of Search ..... 197/1 R, 150; 101/335; 335/258, 274

[56] References Cited

UNITED STATES PATENTS

| | | | |
|---|---|---|---|
| 3,302,562 | 2/1967 | Nelson | 197/1 R X |
| 3,584,575 | 6/1971 | Distl | 197/1 R X |
| 3,654,863 | 4/1972 | Hill et al. | 101/335 |
| 3,672,482 | 6/1972 | Brumbaugh et al. | 197/1 R |
| 3,787,791 | 1/1974 | Borger et al. | 197/1 R X |
| 3,835,975 | 9/1974 | Howard | 197/1 R |
| 3,882,986 | 5/1975 | Howard | 197/1 R |
| 3,889,793 | 6/1975 | Cattaned | 197/1 R |
| 3,893,220 | 7/1975 | Bittner | 197/1 R X |

*Primary Examiner*—Ralph T. Rader

[57] ABSTRACT

A wire printing device comprises a frame removably mounted on a carriage which can move parallely to a platen. On the frame is removably mounted a guide block of resin material which guides a plurality of printing wires individually actuatable by a plurality of electromagnets, mounted on the frame. For an easy assembly of the printing device, a terminal guide is removably mounted on the frame for guiding the printing wires in proximity of the platen. Moreover, between the terminal guide and the guide block, a lubricating pad is disposed at contact with the printing wires and an oil container, mounted on the guide block, is connected through a wick to the pad for holding it constantly impregnated.

8 Claims, 3 Drawing Figures

WIRE PRINTING DEVICE

BACKGROUND OF THE INVENTION

1. Field of Invention

The present invention relates to a wire printing device wherein wires are individually movable lengthwise towards a platen by means of electromagnets, to print on a recording medium backed by said platen, typically through an inked ribbon, characters are built up by the selective printing of elementary dots. It is necessary to provide lateral support for the wires; this may be done by a terminal guide which guides the ends of the wires near the platen and an intermediate guide which guides the wires between the electromagnets and the terminal guide. The problem of lubricating the wires in the guides then arises. Another problem arising in this printing devices is that the terminal guide is very subject to wear, whereby lowering the operating life of the device.

2. Description of the Prior Art

A device is known in which the intermediate guide supports the wires along the entire length between the terminal guide and the armatures of the electromagnets. In this device, a chamber normally filled with lubricating grease and through which all the wires pass is formed in the rear part of the intermediate guide for the wires, rear meaning nearer the platen. As a result of the presence of the lubricant, the friction between the wires and the guides is reduced. Moreover, the ink contained in the inked ribbon disposed between the terminal guide and the recording medium is largely prevented from running back along the printing wires by capillarity, with a consequent reduction of smooth running and the risk of binding of the wires once the ink dries. This printing device, however, has the drawback that, after a fairly brief period of operation, part of the ink in the inked ribbon migrates to the chamber, fouling the grease contained therein; the fouled grease no longer lubricates effectively and is less effective in preventing the ink from running back along the printing wires. Moreover, the replacement of the fouled grease is difficult and laborious.

Another device is known in which the terminal guide for the wires is constituted by two small opposed plates, one of which is fixed to the supporting frame and has a sawtooth-shaped profile for guiding the wires, while the other plate has a substantially plane opposed surface and is pivoted on the supporting frame to hold the wires seated in the notches in the fixed plate, being biased by a compression spring. In this device, only one of the two guide plates is exchangeable, not without difficulty, thus only partially solving the aforesaid problem.

SUMMARY OF THE INVENTION

An object of this invention is to achieve lubrication which is effective over a long period of operation, using means of small dimensions which are easily renewable by the operator.

Another object is to have an easy assembly of the terminal guide with respect to the frame.

Another object is to have a wire printing device in which the electromagnet for actuating the wires are easy assembled with respect to the support frame, are exactly positioned therewith.

A further object is to have a wire printing device in which the electromagnets actuating the wires are of small dimensions, high efficiency and reliable in operation.

BRIEF DESCRIPTION OF THE DRAWING

The invention will be described in more detail, by way of example, with reference to the accompanying drawings, in which.

DESCRIPTION OF A PREFERRED EMBODIMENT OF THE INVENTION

Figure 1:
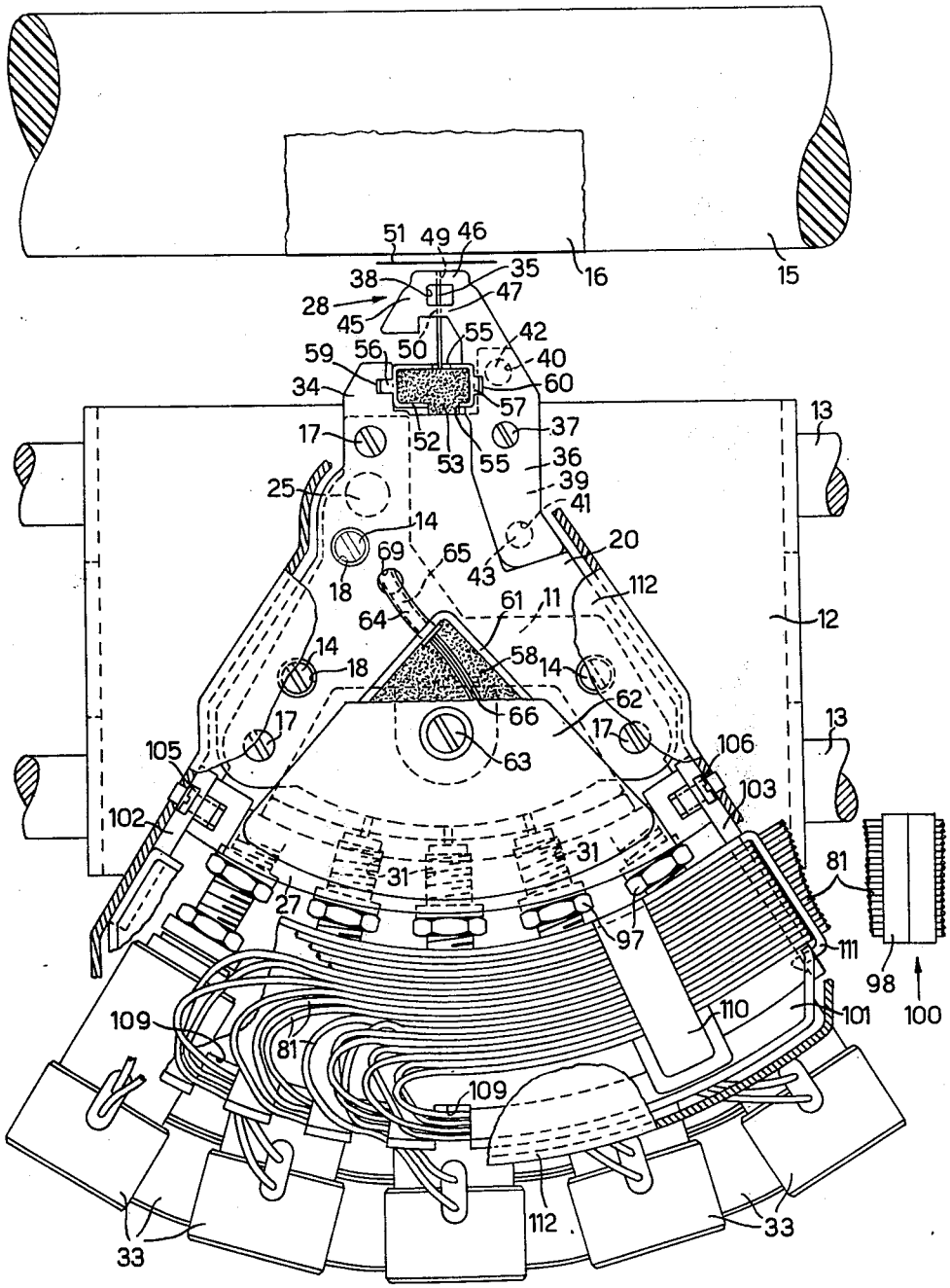
FIG. 1 is a plan view, partly in section, of a device embodying the invention.

Referring to FIG. 1, the printing device includes a light-alloy frame 11 mounted by means of screws 14 on a subjacent carriage 12. The carriage 12 is slidable on suitable guides 13 and is movable in known manner parallel to a platen 15 carrying a recording medium 16. This may be constituted by single sheets of paper, tabulat sheets, cheques or bank forms.

Figure 2:
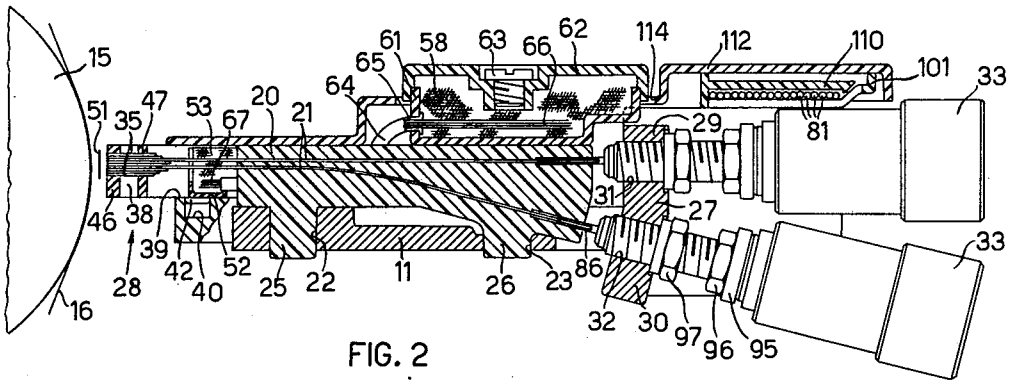
FIG. 2 is a side view, partly in section, of the device.

On top of the frame 11 and fixed thereto by means of clamping screws 17 is mounted a block 20 of epoxy resin suitably filled with molybdenum disulphide and in the interior of which there are formed guide passages 21 (FIG. 2) following predetermined paths. These are formed, for example, during the stage of moulding of the block 20.

For correct and easy positioning of the block 20 with respect to the frame 11, two holes 22 and 23 are formed in the latter into which corresponding studs 25 and 26, respectively, of the block 20 are inserted. Moreover, for ease of access to the screws 14, through holes 18 are formed in the block 20 in correspondence with these screws.

A front rib 27 (FIGS. 1 and 2) of the frame 11 is arcuate and has a substantially vertical upper portion 29 and a lower portion 30 inclined with respect to the first-mentioned portion. In the upper portion 29 there are formed five threaded holes 31 equidistant from each other and having their corresponding axes located in a single horizontal plane. In the lower portion 30, on the other hand, there are formed four threaded holes 32 which, also equidistant from each other, have their axes located in a single plane inclined with respect to the horizontal plane and are staggered between the holes 31. Moreover, the holes 31 and 32 have their axes converging towards a single point which is located between the rib 27 and the platen 15.

Mounted removably in each of the threaded holes 31 and 32 is an electromagnet 33 which controls the axial movement of a corresponding printing wire 35. In this way, the electromagnets 33 are disposed fanwise and in two convergent planes, the upper of which is horizontal and is coplanar with the printing line to permit immediate reading of the characters which are printed.

The wires 35, the number of which is seven or, as in the example being described, nine according to the type of printing it is desired to obtain, are aligned in the rear part of the device, that is in the proximity of the platen 15, in a single vertical plane and are guided by a terminal guide 28 of plastics material of high hardness.

The terminal guide 28 comprises an arm 36 mounted removably, for example by means of a clamping screw 37, on a ledge 39 of the block 20. Moreover, for correct positioning of the arm 36 with respect to the block 20, two holes 40 and 41 are formed in the latter and corresponding studs 42 and 43, respectively, on the support 36 are seated in these holes.

One end 45 of the arm 36 is provided with two walls 46 and 47 which are substantially parallel to the platen 15 and define between them a space 38 through which pass the printing wires 35. A series of through holes 49 and 50, respectively, are formed in these walls 46 and 47, these holes having their axes located in a single vertical plane which is at right angles to the platen 15. The rear ends of the printing wires 35 slide in these through holes 49 and 50. The wall 46 can be of hard stone. Moreover, between the wall 46 of the guide 28 and the platen 15 there is arranged an inked ribbon 51 which is fed in manner known per se.

Each printing wire 35 is guided slidably in a corresponding guide passage 21 of the resin block 20 in the section between the terminal guide 28 and the corresponding electromagnet 33.

Between the arm 36 and a rear portion 34 of the block 20 is arranged a container 52 inside which is disposed lubricating felt 53 through which the printing wires 35 pass. More particularly, the container 52 is formed by a parallelepipedal casing of plastics material provided with two opposed slots 55, for permitting the passage of the wires 35, and with two lateral guides 56 and 57 respectively seated in a slot 59 in the block 20 and a slot 60 in the arm 36. A front portion of the felt 53 emerges from the container 52 through the front slot 55 and is in contact with that part of the block 20 from which the printing wires 35 emerge.

A reservoir 61 containing felt 58 saturated with lubricating oil is mounted on top of the block 20 and has a closing cover 62 provided with a hole closed by a plug 63. A wick 65 of fibre, for example cotton, contained inside a tube 64 has one end 66 enveloped in the felt 58 in the reservoir 61 and one end 67 in contact with the lubricating felt 53; the tube 64 is housed in turn in a cavity 69 in the block 20.

Figure 3:
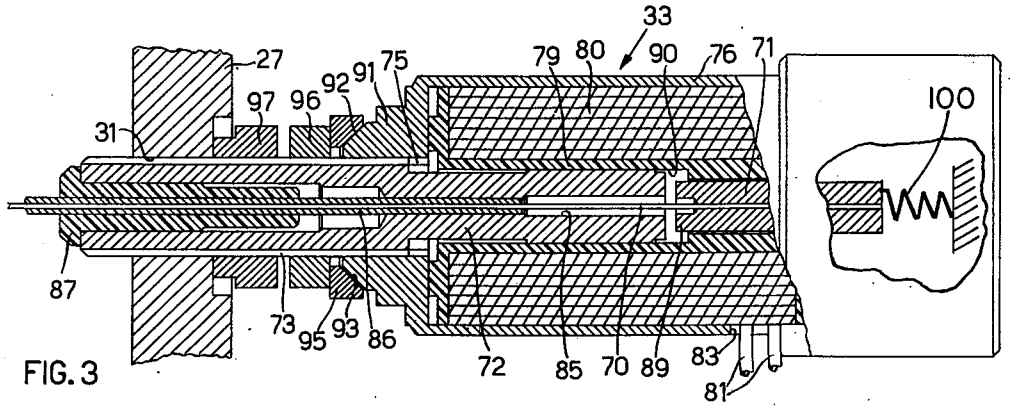
FIG. 3 shows a detail on a larger scale and partly in section.

Each of the electromagnets 33 (FIG. 3) comprises a cylindrical stem 72 formed of a material of high magnetic permeability, for example ferronickel, and having an externally threaded portion 73 screwed into the corresponding threaded hole 31 or 32 of the frame 11.

On the stem 72 there is also screwed a threaded portion 75 of an outer casing 76 of the electromagnet 33, which is also made of a high-permeability material, for example ferronickel, and has a substantially tubular form. The stem 72 extends inside the casing 76 and a core 79 of plastics material is arranged between the walls of the casing 76 and the stem 72. This core 79 is provided with two terminal flanges connected to the inner walls of the casing 76, and with a central body provided with a through axial bore 90 having two portions, a front and a rear portion, respectively, the front portion having a smaller cross-section. On the cylindrical body of the core 79 there is moreover wound an exciting coil 80, the supply wires 81 of which emerge from a hole 83 in the casing 76.

Arranged coaxially with the core 79 and slidable axially in the front portion of the bore 90 is an armature 71 having a rear portion 89 housed with a wide clearance in the rear portion of the bore 90. The front terminal portion 70 of the printing wire 35 is fixed rigidly to the armature 71. This terminal portion is housed in an axial cavity 85 in the stem 72 and is moreover guided by a guide tube 86. The tube 86 is of bronze and has a central portion fitted into a sleeve 87 of plastics material fitted in turn into the cavity 85, and a rear portion (FIG. 2) housed in a widened part of the front terminal portion of the corresponding guide passage 21.

Between the armature 71 and the casing 76 there is arranged a suitable return spring 100, which, when the electromagnet 33 is de-energized, keeps the armature 71 spaced from the front end of the stem 72. Such a spring is shown in U.S. Pat. No. 3,584,575.

The rear portion 91 of the casing 76 has an annular outer surface 92 constituted by a spherical sector, which is normally coupled with a corresponding conical surface 93 of a washer 95. A first lock nut 96 screwed on to the threaded portion 73 of the stem 72 holds the washer 95 against the surface 92 of the casing 76. A second lock nut 97 keeps the stem 72 locked to the rib 27 of the frame 11.

To lead the supply wires 81 (FIG. 1) of the exciting coils 80 towards a part 98 of a connector 100 connected to the driving circuit (not shown in the drawing), there is arranged above the electromagnets 33 a holder 101 of plastics material which has two lateral lugs 102 and 103 by which it is fixed to the sides of the rib 27 of the frame 11 by means of fixing screws 105 and 106 and two locating pins not visible in the drawing. This holder 101 is provided in its front portion with notches 109 (FIG. 1) through which the supply cables 81 are led to the subjacent electromagnets 33. Moreover, a first guide tongue 110 and a second guide tongue 111 below which the cables 81 pass are respectively arranged one on top of, and one laterally with respect to, the holder 101 and serve to hold the cables 81 in contact with the holder.

For covering the supply cables 81, the block 20 and the lubricating felt 53 there is finally provided a single cover 112 of plastics material which is fixed removably to the frame 11 by means of snap tongues or tabs not shown in the drawing and in which a recess 114 (FIG. 2) is formed to permit easy access to the plug 63 of the lubricating oil reservoir 61.

The parts of the printing device described up to this point are assembled in the following manner. The individual printing wires 35 are assembled with the corresponding electromagnets 33. The guide tube 86 (FIG. 3) and the corresponding sleeve 87 are fitted into the axial cavity 85 of the central stem 72. Separately, inside the casing 76, there is mounted the core 79, on which the exciting coil 80 has been previously wound, the wires 81 of the coil being threaded out through the hole 83 in the casing 76. The threaded portion 75 of the casing 76 is then screwed on to the threaded portion 73 of the stem 72, the stem being made to enter inside the bore 90 in the core 79.

Provision is now made for fixing the terminal portion 70 of the printing wire 35 to the armature 71 and, thereafter, inserting the wire 35 into the guide tube 86, the armature 71 is brought into the front part of the bore 90 and its portion 89 is housed in the wider rear portion of the bore 90; the wide clearance existing between the end 89 of the armature 71 and the rear portion of the bore 90 ensures that possible deformation of the end 89 due to idle impact of the armature 71 against the stem 72 will not jeopardize the smooth action of the said armature 71 inside the core 79. In a manner known per se, the armature 71 is connected to the outer casing 76 through the medium of a suitable return spring, to which a predetermined initial load is given by suitable adjusting means not shown in the drawing. By screwing the stem 72 into, or unscrewing it from, the casing 76, the distance between the end 89 of the armature 71 and the rear end of the stem 72 is then adjusted, so that the striking force of the corresponding wire 35 can be predetermined accurately.

The conical surface 93 of the washer 95 is thereafter brought against the spherical surface 92 of the casing 76 by locking the washer itself with the lock nut 96. In this way, the stem 72 is locked to the casing 76 and any possible play in the threaded coupling means between the stem 72 and the casing 76 is taken up, moreover ensuring perfect co-axiality between these two elements without any forcing on to the core 79.

The block 20 is mounted on the supporting frame 11 (FIG. 1), the studs 25 and 26 (FIG. 2) of the block being seated in the holes 22 and 23 in the frame 11 and the two parts being then secured together with the screws 17. The reservoir 61 is then mounted on top of the block 20, the felt 58 and the end 66 of the wick 65 having been previously inserted in the reservoir. The tube 64 is inserted in the cavity 69 in the block 20.

The terminal guide 28 is now mounted on the ledge 39 (FIG. 1) of the block 20, the studs 42 and 43 of the arm 36 being seated in the holes 40 and 41 in the block 20 and the two parts being then clamped together with the screw 37. The container 52 is arranged between the arm 36 and the rear portion 34 of the block 20, the guides 56 and 57 of the container being seated in the slots 59 and 60, respectively. The end 67 of the wick 65 (FIG. 2) is then arranged inside the container 52. The electromagnets 33, assembled as has been seen hereinbefore, are then mounted on the frame 11.

The printing wires 35 controlled by the four lower electromagnets 33 are inserted into the corresponding lower guide passages 21 and into the holes 49 and 50 of the terminal guide 28, in such manner that they become the four lowest wires of the series. The wires 35 controlled by the upper electromagnets 3, on the other hand, are inserted into the corresponding upper guide passages 21 and into the holes 49 and 50, in such manner that the wires 35 controlled by the two lateral electromagnets 33 become the two highest wires of the series.

The stem 72 of each electromagnet 33 is then screwed into the corresponding threaded holes 30, 31 until the guide tubes 86 are housed inside the widened part of the front portion of the guide passages 21 and until the rear terminal portion of the printing wire 35 is brought into line with the wall 46 of the terminal guide 28. Each electromagnet 33 mounted in this way on the frame 11 is finally clamped thereto by the lock nut 97.

The container 52 is now filled with the lubricating felt 53 and the reservoir 61 with lubricating oil. The oil travels through the wick 65 by capillarity and is conveyed to the felt 53, which is therefore kept saturated with oil.

On the top of the electromagnets 53 and fixed to the frame 11 by means of the screws 105 and 106 is arranged the holder 101, on which are arranged the supply wires 81 connecting the exciting coils to the connector 100.

Before the wires 81 are connected to the connector 100, they form a more or less wide loop, according to the distance between the connector 100 and the exciting coil 80. This enables the distance of the printing wire 35 from the platen 15 to be adjusted even after the cables 81 have been connected to the connector 100. Moreover, the electromagnets 33 may be assembled and furnished with supply wires of the same length and already equipped with the electric terminals to be inserted in the part 98 of the connector 100 in manner known per se.

The supporting frame 11 is mounted on the carriage 12 by means of the clamping screws 14 passed through the holes 18 in the block 20 and, finally, the cover 112 which is fixed by a snap action to the frame 11 is arranged as covering for the supply cables, the block 20 and the felt 53.

The operation of the printing device takes place in known manner by shifting of the carriage 12 parallel to the platen 15 and by selective actuation of the electromagnets 33, which cause the printing wires 35 to transfer the ink of the ribbon 51 to the sheet of paper 16 and obtain in this way the printing of the characters in a matrix of dots.

The printing device enables both printing with seven wires and printing with nine wires to be achieved. As has been seen, the four lower electromagnets control the four lower wires, while the five upper electromagnets control the five upper wires. Therefore, to change from nine-wire printing to seven-wire printing it is sufficient to remove from the frame 11 the two electromagnets 35 located at the ends of the upper fan and the corresponding printing wires 35, without taking action on other elements of the device.

When the printing device is prearranged for printing with seven wires, its dimensions in the transverse direction are greatly reduced. In fact, four electromagnets remain on the frame 11 in the lower plane and the device itself may be easily couplable in series with others to obtain serial-parallel printing rather than purely serial printing.

The lubrication of the printing wires 35 is effected by the felt 53 which, being constantly saturated with oil, transfers the lubricant to the wires themselves at the point at which they pass through the felt. Moreover, by capillarity, the lubricant is also conveyed from the wires themselves to the interior of the guide passages 21, thus ensuring constant lubrication along the entire path of the wires.

The felt 53, moreover, being pressed against the printing wires 35, prevents the ink contained in the inked ribbon 51 from migrating by capillarity along the wires 35 as far as the guide passages 21. In fact, once the ink has arrived at the felt 53, it is absorbed thereby and retained inside the container 52. When the felt 53 becomes fouled or soiled to the point of becoming inefficient, replacement thereof can be carried out by the operator himself after removal of the closing cover 112, while the lubricating oil can easily be replenished through the plug 63.

The printing device moreover enables the rear guide support 36 to be replaced with ease. To do this, in fact, the entire assembly mounted on the carriage 12 is removed by undoing the screws 14 which secure the frame 11 to the carriage 12. The arm 36 is then removed by sliding it to the rear off the wires after previously removing the clamping screw 37.

The lubricating felt 53 and the felt 58 may be made of any suitable fibre, animal, vegetable or artificial.

What we claim is:

1. In a wire printing device comprising a platen, a recording medium supported by said platen, a carriage movable parallel to said platen, a base member removably mounted on said carriage, and a plurality of printing wires actuatable for striking said recording medium, each one of said wires having a terminal portion located in proximity to said recording medium and a first portion spaced from said terminal portion, a plurality of electromagnetic actuating means, one of said electromagnetic actuating means being connected to said first portion of each of said printing wires to individually activate said printing wire, first mounting means for adjustably and removably mounting each one of said actuating means on said base member, central guide means in slidable contact with said printing wires at a point between said terminal portion and said first portion, second mounting means for removably mounting said central guide means on said base member, terminal guide means disposed in the proximity of said platen for guiding said terminal portion of said wires, third mounting means for removably mounting said terminal guide means on said base member, lubricating means for lubricating said printing wires during the slidable contact of said printing wires with said central guide means, forth mounting means for removably mounting said lubricating means on said base member, each one of said electromagnetic actuating means including a magnetic circuit comprising a tubular casing of a material of high magnetic permeability having a frontward threaded portion, an annular core of a nonmagnetic material disposed inside said tubular casing substantially coaxial thereto, said core having means defining a central bore, an excitable coil wound around said annular core between said core and said tubular casing, a cylindrically shaped armature disposed in said bore and movable between a rest position and a work position upon excitation of said coil, said armature having a front end connected to said first position of one corresponding of said printing wires and a front face and a rear end connected through a return spring to said tubular casing, a cylindrical stem of a material of high magnetic permeability having a rearward portion lodged in said central bore with a rear face in opposed relationship to said front face of said armature and defining a gap therebetween, said return spring loading said armature with a predetermined load into said rest position to be overcome upon excitation of said coil moving said armature to said work position, said stem having an axial bore substantially coaxial with said central bore for accommodating said one corresponding printing wire and a central threaded portion coupled with said frontward threaded portion of said tubular casing for axial movement with respect to said tubular casing for varying said gap between said armature and said stem.

2. A wire printing device according to claim 1, wherein said frontward portion of said tubular casing has a substantially spherical outer surface, and wherein said first mounting means comprises a threaded opening in said base member into which is screwable said threaded portion of said stem, a first nut screwed to said threaded portion of said stem for locking said stem with respect to said base member, a washer coaxial with said stem and having an inclined annular surface engageable with said spherical surface of said tubular casing, and a second nut screwed onto said threaded portion of said stem for adjustably locking said casing to said stem.

3. A wire printing device according to claim 1, wherein said lubricating means comprises a lubricating oil container mounted on said central guide, a first fibrous pad lodged in said oil container to be constantly impregnated by said lubricating oil, a second pad disposed between said terminal guide and said central guide and in contact with said wires and a fibrous wick connecting said first pad to said second pad and wherein said fourth mounting means comprises a removable container having a cavity for containing said second pad therein, and two lateral guides seated in two corresponding slots, one of said slots being formed in said central guide and the other of said slots being formed in said terminal guide.

4. A wire printing device comprising a platen, a recording medium supported by said platen, a base member mounted adjacent to said platen, a plurality of printing wires actuatable for striking said recording medium, each one of said printing wires having a terminal portion located in proximity of said recording medium, a terminal guide mounted with respect to said base member for guiding said terminal portion of said wires, a central guide mounted on said base member in slidable contact with said printing wires, lubricating means for lubricating said printing wires and mounting means for removably mounting said lubricating means with respect to said base member, said lubricating means comprising a lubricating oil container mounted on said base member, a first fibrous pad lodged in said oil container to be constantly impregnated by said lubricating oil, a second pad disposed between said terminal guide and said central guide and in contact with said wires, a fibrous wick connecting said first pad to said second pad, said mounting means comprising a removable container having a cavity for containing said second pad therein, and two lateral guides seated in two corresponding slots, one of said slots being formed in said central guide and the other of said slots being formed in said terminal guide.

5. In a wire printing device a type head comprising a base member, a plurality of actuatable printing wires slidably mounted on said base member, and a plurality of electromagnetic actuating means for actuating said printing wires, each one of said actuating means including a magnetic circuit comprising: a tubular casing of high magnetic permeability material having a frontward threaded portion; an annular core of a nonmagnetic material disposed inside said tubular casing substantially coaxial thereto, said core having means defining a central bore; an excitable coil wound around said annular core between said core and said tubular casing; a cylindrically shaped armature disposed in said bore and movable between a rest position and a work position upon excitation of said coil, said armature having a front end connected to one corresponding of said printing wires and a front face and a rear end connected through a return spring to said tubular casing, said return spring loading said armature with a predetermined load into said rest position to be overcome upon excitation of said coil moving said armature to said work position, and a cylindrical stem of a high magnetic permeability material having a rearward portion lodged in said central bore and having a rear face in opposed relationship to said front face of said armature and defining a gap therebetween, said stem being substantially coaxial with said casing and having an axial bore substantially coaxial with said central bore for accommodating said one corresponding printing wire and a central threaded portion coupled with said frontward threaded portion of said tubular casing for axial movement with respect to said tubular casing for varying said gap between said armature and said stem.

6. A type head according to claim 5 further comprising mounting means for adjustably mounting said actuating means on said base member, wherein said frontward portion of said tubular casing has a substantially spherical outer surface, and wherein said mounting means comprises a threaded opening in said base member into which is screwable said threaded portion of said stem, a first nut screwed to said threaded portion of said stem for locking said stem with respect to said base member, a washer coaxial to said stem and having a substantially frusto-conical surface coupled to said spherical surface of said tubular casing, and a second nut screwed to said threaded portion of said stem for adjustably locking said casing to said stem.

7. A type head according to claim 5, further comprising a plurality of electric wires having all the same length, said electric wires connecting said excitable coils to a common connector, a single holder being mounted on said base member for holding said electric wires.

8. A type head according to claim 5, further comprising an enlarged circumferential groove located in said central bore of said annular core in axial alignment with said gap and extending axially at least slightly past said front face of said armature and said rear face of said stem, whereby said central bore freely accommodates said front end of said armature upon deformation thereof radially outwardly because of impact between said armature and said stem.

* * * * *